US011953246B2

(12) United States Patent
Yamaguchi

(10) Patent No.: US 11,953,246 B2
(45) Date of Patent: Apr. 9, 2024

(54) COMPRESSION APPARATUS

(71) Applicant: DAIKIN INDUSTRIES, LTD., Osaka (JP)

(72) Inventor: Masaki Yamaguchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/246,747

(22) PCT Filed: Aug. 6, 2021

(86) PCT No.: PCT/JP2021/029389
§ 371 (c)(1),
(2) Date: Mar. 27, 2023

(87) PCT Pub. No.: WO2022/070615
PCT Pub. Date: Apr. 7, 2022

(65) Prior Publication Data

US 2023/0272951 A1 Aug. 31, 2023

(30) Foreign Application Priority Data

Sep. 30, 2020 (JP) ..... 2020-165578

(51) Int. Cl.
*F25B 43/02* (2006.01)
*F25B 1/10* (2006.01)
*F25B 31/00* (2006.01)

(52) U.S. Cl.
CPC ..... *F25B 43/02* (2013.01); *F25B 1/10* (2013.01); *F25B 31/002* (2013.01); (Continued)

(58) Field of Classification Search
CPC ..... F25B 1/10; F25B 31/002; F25B 31/004; F25B 2500/16; F25B 2700/03; F25B 43/02
See application file for complete search history.

(56) References Cited

U.S. PATENT DOCUMENTS 8,109,116 B2 * 2/2012 Sekiya ..... F04C 23/008 62/498
10,337,766 B2 * 7/2019 Takizawa ..... F25B 1/00
(Continued)

FOREIGN PATENT DOCUMENTS

CN 204787380 U * 11/2015
CN 106440521 A * 2/2017 ..... F25B 31/002
(Continued)

OTHER PUBLICATIONS

International Search Report for PCT/JP2021/029389 dated Oct. 5, 2021.

(Continued)

*Primary Examiner* — Miguel A Diaz
(74) *Attorney, Agent, or Firm* — IPUSA, PLLC

(57) ABSTRACT

A technique that allows a plurality of series-connected compressors in a refrigerant circuit to have equal amounts of oil in a more versatile manner is provided. A compression apparatus according to an embodiment in the disclosure includes series-connected compressors 10, 20 in a refrigerant circuit 1 that is to circulate a refrigerant; an oil separator 30 is provided in a discharge passage 50 of the compressor 10 of the compressors 10, 20, and separates oil from the refrigerant discharged from the compressor 10 and causes the refrigerant separated from the oil to flow downstream (intake passage 80); an oil return passage 70 returns the oil separated by the oil separator 30 to the compressor 10 neighboring upstream; an oil discharge outlet 10A is provided in the compressor 10; and an oil discharge passage 60 connects the oil discharge outlet 10A to an inlet of the oil separator 30.

10 Claims, 15 Drawing Sheets

(52) U.S. Cl.
CPC ..... *F25B 2500/16* (2013.01); *F25B 2600/022* (2013.01); *F25B 2600/0253* (2013.01); *F25B 2700/03* (2013.01)

(56) References Cited

U.S. PATENT DOCUMENTS

| | | | | |
|---|---|---|---|---|
| 10,443,910 | B2 * | 10/2019 | Kimura | F25B 31/004 |
| 10,605,492 | B2 * | 3/2020 | Ozu | F25B 31/002 |
| 2007/0033954 | A1 * | 2/2007 | Jang | F25B 49/022 62/149 |
| 2010/0186439 | A1 * | 7/2010 | Ogata | F04B 39/023 62/402 |
| 2012/0023978 | A1 * | 2/2012 | Chae | F25B 5/02 62/115 |
| 2015/0068229 | A1 * | 3/2015 | Oh | F25B 31/004 62/84 |
| 2015/0114013 | A1 * | 4/2015 | Joo | F25B 43/02 62/84 |
| 2015/0184910 | A1 * | 7/2015 | Yoon | F25B 31/004 62/193 |
| 2017/0284706 | A1 * | 10/2017 | Ozu | F25B 31/002 |
| 2018/0209696 | A1 * | 7/2018 | Takizawa | F25B 43/02 |

FOREIGN PATENT DOCUMENTS

| | | | | |
|---|---|---|---|---|
| EP | 1939547 | A1 * | 7/2008 | F01C 1/0223 |
| EP | 2565562 | A2 * | 3/2013 | F25B 31/004 |
| EP | 3040643 | | 7/2016 | |
| EP | 3392577 | | 10/2018 | |
| JP | 2008-261227 | | 10/2008 | |
| JP | 2008261227 | A * | 10/2008 | |
| JP | 2010014349 | A * | 1/2010 | F25B 1/10 |
| JP | 4454323 | | 4/2010 | |
| JP | 2013024447 | A * | 2/2013 | |
| JP | 2014196874 | A * | 10/2014 | |
| JP | 2015-068564 | | 4/2015 | |
| JP | 2015068564 | A * | 4/2015 | F25B 1/10 |
| JP | 2020-084901 | | 6/2020 | |
| KR | 100592955 | B1 * | 6/2006 | |
| KR | 20070025108 | A * | 3/2007 | |
| KR | 20180121141 | A * | 11/2018 | |
| WO | 2017/170356 | | 10/2017 | |

OTHER PUBLICATIONS

International Preliminary Report on Patentability for PCT/JP2021/029389 dated Apr. 13, 2023.

Extended European Search Report mailed on Jan. 2, 2024 issued with respect to the corresponding European patent application No. 21874918.2.

* cited by examiner

COMPRESSION APPARATUS

TECHNICAL FIELD

This disclosure relates to a compression apparatus provided in a refrigerant circuit.

BACKGROUND ART

For example, an oil equalization technique related to a plurality of compressors that are connected in series in a refrigerant circuit is known (see Patent Document 1).

In Patent Document 1, two compressors are connected in series, and an oil separator is provided on the discharge side of a high-stage compressor. An oil drain passage for discharging oil from the side surface of a low-stage compressor is connected to an intake tube of the high-stage compressor, and an oil drain passage for discharging oil from the side surface of the high-stage compressor is connected to the intake side of the oil separator. The oil separated by the oil separator is returned to the intake side of the low-stage compressor through an oil return passage. As a result, the oil levels of the two series-connected compressors can be kept constant based on the actions of the oil drain passages of the two compressors, the oil separator, and the oil return path.

RELATED-ART DOCUMENTS

Patent Documents

[Patent Document 1] Japanese Patent Application Publication No. 2008-261227

SUMMARY OF THE INVENTION

Problem to be Solved by the Invention

However, in the above-described technique, all of the compressors need to have an oil discharge outlet for discharging excess oil. Hence, the above-described technique cannot be adopted in a case where, for example, a compressor without an oil discharge outlet is included in the plurality of series-connected compressors.

The present disclosure aims to provide a technique that allows a plurality of series-connected compressors in a refrigerant circuit to have equal amounts of oil in a more versatile manner.

Means to Solve the Problem

In one embodiment according to the disclosure, there is provided a compression apparatus that includes a plurality of compressors (10, 20) connected in series in a refrigerant circuit (1) that is configured to circulate a refrigerant; an oil separator (30) provided in a discharge passage of one compressor (10) of the plurality of compressors (10, 20), and configured to separate oil from the refrigerant discharged from the one compressor (10) and to cause the refrigerant separated from the oil to flow downstream; an oil return passage (70) provided with the one compressor (10) and configured to return the oil separated by the oil separator (30) to an intake passage (40) of the one compressor (10); an oil discharge outlet (10A) provided in the one compressor (10); and an oil discharge passage (60) configured to connect the oil discharge outlet (10A) to an inlet of the oil separator (30).

According to the embodiment, the compression apparatus can cause the oil separator (30) to separate the oil contained in the refrigerant that is discharged from the one compressor (10) provided with the oil separator (30) and to return the oil to the one compressor (10) through the oil return passage (70). Hence, for example, in an operating state where the flow rate of oil discharged from the one compressor (10) is higher than the flow rate of oil received by the one compressor (10), the compression apparatus can suppress a reduction in the amount of oil contained in the one compressor (10). The compression apparatus can also suppress an increase in the flow rate of oil received by another compressor (20) by causing the oil separator (30) to separate at least some of the oil to reduce the flow rate of oil discharged together with the refrigerant. Hence, for example, in an operating state where the flow rate of oil discharged from the one compressor (10) is higher than the flow rate of oil received by the one compressor (10), it is possible to suppress an increase in the amount of oil contained in the other compressor (20). Also, when the oil level in the one compressor (10) is higher than the oil discharge outlet, the compression apparatus can cause the oil contained in the one compressor (10) to be discharged to the inlet of the oil separator (30) through the oil discharge passage (60). Hence, for example, in an operating state where the flow rate of oil received by the one compressor (10) is higher than the flow rate of oil discharged from the one compressor (10), it is possible to suppress an increase in the amount of oil contained in the one compressor (10). Furthermore, when the oil contained in the one compressor (10) is discharged through the oil discharge passage (60) and the flow rate of oil that flows into the oil separator (30) relatively increases, the compression apparatus can reduce the oil separation efficiency of the oil separator (30) to increase the flow rate of oil that flows downstream from the oil separator (30). This is because the flow rate of the oil return path (70) can be limited. Hence, for example, in an operating state where the flow rate of oil received by the one compressor (10) is higher than the flow rate of oil discharged from the one compressor (10), it is possible to suppress a reduction in the flow rate of oil received by the other compressor (20). As a result, it is possible to suppress a reduction in the amount of oil contained in the other compressor (20). Therefore, the compression apparatus can equalize the respective amounts of oil contained in the plurality of compressors even in a case where the compressor (20) other than the one compressor does not include the oil discharge outlet.

Further, in the above-described embodiment, an oil discharge outlet may not be provided in the other compressor (20) that is different from the one compressor (10) of the plurality of compressors (10, 20).

Further, in the above-described embodiment, the oil separator (30) may be configured such that the flow rate of oil discharged downstream from the oil separator (30) when no oil is accumulated in the oil separator (30) is lower than the flow rate of oil discharged from the other compressor (20).

Further, in the above-described embodiment, the oil discharge passage (60) may be configured such that the oil does not accumulate to a height that is higher than or equal to a height at which the oil discharge outlet (10A) is provided in the one compressor (10).

Further, in the above-described embodiment, the oil return passage (70) may limit the flow rate of oil such that the flow rate is less than an oil separation amount per unit time of the oil separator (30).

Further, in the above-described embodiment, the flow rate of oil discharged from the one compressor (10) through the oil discharge passage (60) increases due to separated oil being returned to the one compressor (10) from the oil separator (30) through the oil return passage (70).

Further, in the above-described embodiment, in the oil separator (30), an increase in a flow rate of oil that flows in from the one compressor (10) through the discharge passage (50) and the oil discharge passage (60) causes the oil separation amount per unit time to increase and the oil separation amount to increases relative to a flow rate of oil returned by the oil return passage (70) such that the oil is accumulated inside the oil separator. The accumulation of the oil in the oil separator reduces the oil separation efficiency such that the flow rate of oil discharged downstream is increased.

Further, in the above-described embodiment, when there is no change in the flow rate of oil discharged from the other compressor (20), the accumulation of the oil in the oil separator (30) increases the flow rate of oil that is discharged from the oil separator (30) and is received by the other compressor (20) relative to a state where the oil is not accumulated in the oil separator, and increases the flow rate of oil received by the other compressor (20) relative to the state where the oil is not accumulated in the oil separator, such that the flow rate of oil received by the other compressor (20) is in balance with the oil discharge flow rate of the other compressor (20).

Further, in the above-described embodiment, when the flow rate of oil discharged from the other compressor (20) increases, the increase in the flow rate of oil that is discharged from the other compressor (20) and is received by the one compressor (10) increases the flow rate of oil that flows into the oil separator (30) from the compressor (10) through the oil discharge passage (60). The increase in the flow rate of oil that flows into the oil separator (30) causes the oil in the oil separator (30) to overflow. The overflow of the oil in the oil separator (30) increases the flow rate of oil that is discharged from the oil separator (30) and is received by the other compressor (20). The increase in the flow rate of oil received by the other compressor (20) causes the flow rate of oil received by the other compressor (20) to be in balance with the flow rate of oil discharged from the other compressor (20).

Further, in the above-described embodiment, when the flow rate of oil discharged from the other compressor (20) decreases, the decrease in the flow rate of oil that is discharged from the other compressor (20) and is received by the one compressor (10) decreases the flow rate of oil that flows into the oil separator (30) from the one compressor (10) through the oil discharge passage (60). The decrease in the flow rate of oil that flows into the oil separator (30) decreases the oil separation amount of the oil separator (30) such that the flow rate of oil returned by the oil return passage (70) increases relative to the oil separation amount. The increase in the flow rate of oil returned by the oil return passage (70) relative to the oil separation amount decreases the oil in the oil separator (30) such that the oil separation efficiency of the oil separator (30) is increased. The increase in the oil separation efficiency of the oil separator (30) decreases the flow rate of oil that is discharged from the oil separator (30) and is received by the other compressor (20). The decrease in the flow rate of oil received by the other compressor (20) causes the flow rate of oil received by the other compressor (20) to be in balance with the flow rate of oil discharged from the other compressor (20).

Effect of Invention

According to the above-described embodiments, the amounts of oil contained in a plurality of series-connected compressors in a refrigerant circuit can be equalized in a more versatile manner.

MODE FOR CARRYING OUT THE INVENTION

Hereinafter, an embodiment of this disclosure will be described with reference to the accompanying drawings.

Configuration of Compression Apparatus

The configuration of a compression apparatus 100 will be described first with reference to FIG. 1.

Figure 1:
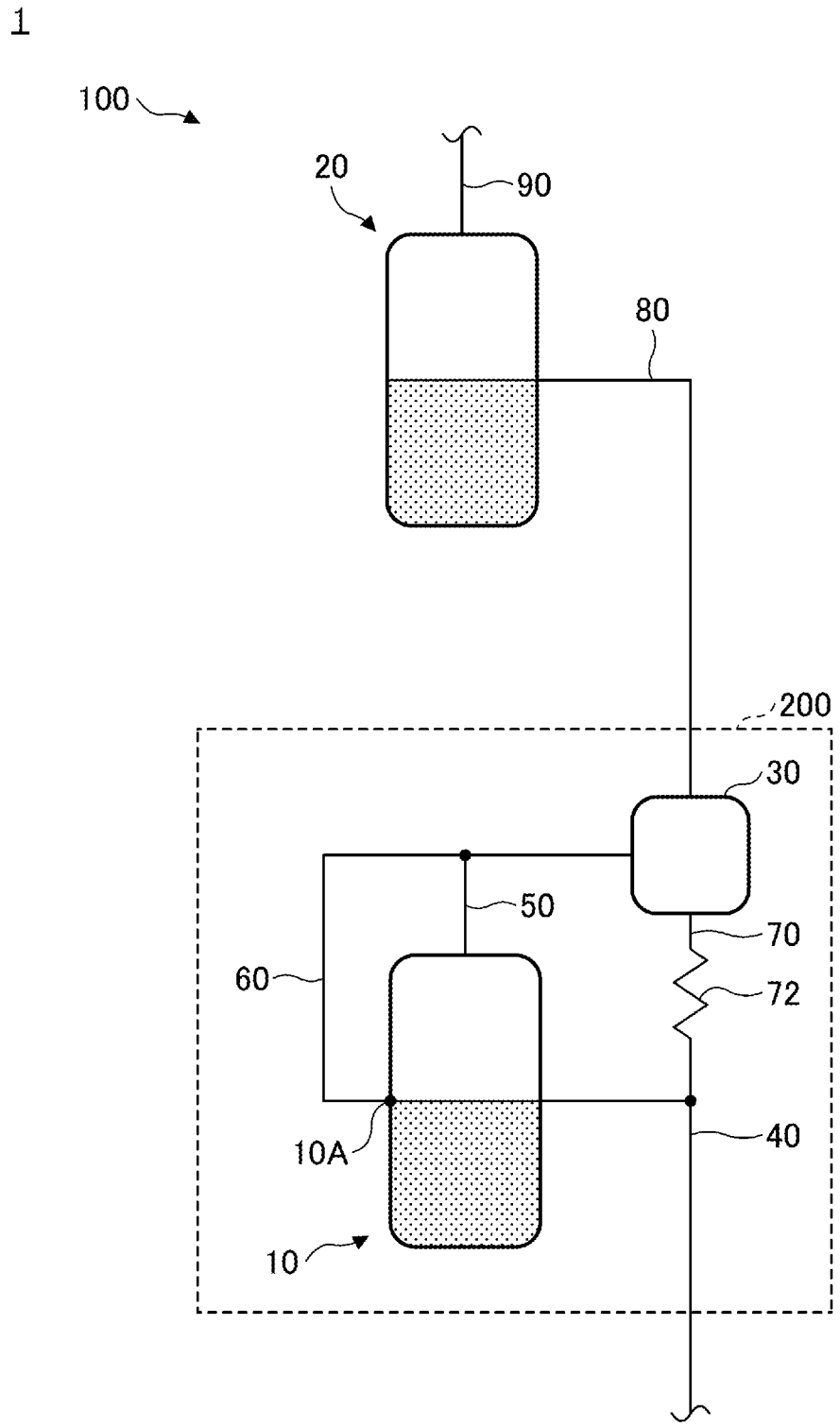
FIG. 1 is a diagram illustrating an example of the configuration of a compression apparatus.

FIG. 1 is a diagram illustrating an example of the configuration of the compression apparatus 100 according to the embodiment.

The compression apparatus 100 is provided in a refrigerant circuit 1, which circulates a predetermined refrigerant (to be simply referred to as a "refrigerant" hereinafter) in a heat exchange system such as an air conditioning system or a water heating system, and compresses the refrigerant at a high pressure. Examples of the refrigerant include hydrofluorocarbons (HFCs).

The compression apparatus 100 includes, compressors 10 and 20, an oil separator 30, an intake passage 40, a discharge passage 50, an oil discharge passage 60, an oil return passage 70, an intake passage 80, and a discharge passage 90.

The compressors 10 and 20 are connected in series in the refrigerant circuit 1. The compressors 10 and 20 each are, for example, a dome-type scroll compressor.

An oil discharge outlet 10A is provided at a predetermined height position on the side surface of the housing (casing) of the compressor 10 of the compressors 10 and 20.

The oil separator 30 is provided on the discharge side of the compressor 10 on the low-stage side in the refrigerant circuit 1. The oil separator 30 separates oil from an inflowing refrigerant containing the oil, and outputs the refrigerant from which the oil has been separated.

The intake passage 40 is formed as, for example, a conduit, and is connected to an intake port of the compressor 10. The compressor 10 receives the refrigerant of the refrigerant circuit 1 through the intake passage 40.

The discharge passage 50 is formed as, for example, a conduit, and connects a discharge port of the compressor 10 to an inlet of the oil separator 30. The compressor 10 discharges the compressed refrigerant to the discharge passage 50, and the oil separator 30 separates the oil contained in the refrigerant discharged from the compressor 10.

The oil discharge passage 60 is formed as, for example, a conduit, and connects the oil discharge outlet 10A of the compressor 10 to the discharge passage 50. The cross-sectional area (inside diameter), the length, the shape, the merging point with the discharge passage 50, and the like of the oil discharge passage 60 are configured such that, for example, when the oil level inside the compressor 10 reaches the oil discharge outlet 10A, oil accumulated further is discharged outside. This configuration allows the excess oil that accumulates to a height higher than or equal to the height of the oil discharge outlet 10A to be discharged from the compressor 10 to the discharge passage 50 through the oil discharge outlet 10A and the oil discharge passage 60. Hence, the oil in the compressor 10 that is discharged to the discharge passage 50 is introduced to the oil separator 30 through the discharge passage 50.

Note that one end of the oil discharge passage 60 may be directly connected to the inlet of the oil separator 30 instead of being connected to the discharge passage 50.

The oil return passage 70 is formed as, for example, a conduit, and connects the oil discharge outlet of the oil separator 30 to the intake passage 40. The oil return passage 70 includes a capillary tube 72. As a result, the oil separated by the oil separator 30 is introduced to the intake passage 40 through the oil return passage 70, and is received by the compressor 10 together with the refrigerant from the intake passage 40.

The intake passage 80 is formed as, for example, a conduit, and connects the outlet of the oil separator 30 with the inlet of the compressor 20. The compressor 10 receives the refrigerant, which is output from the oil separator 30 and has been separated from the oil, through the intake passage 80.

The discharge passage 90 is formed as, for example, a conduit, and is connected to the discharge outlet of the compressor 20. The compressor 20 discharges the compressed refrigerant to the discharge passage 90.

The components including the compressor 10, the oil separator 30, the intake passage 40, the discharge passage 50, the oil discharge passage 60, the oil return passage 70, and the like may also be formed integrally as one compressor unit 200.

Further, an accumulator that separates the liquid refrigerant may be provided upstream relative to the merging point with the oil return passage 70 in the intake passage 40. An accumulator may also be provided in a similar manner in the intake passage 80.

Operation of Compressors According to Comparative Examples

The operation of compression apparatuses 100*c* and 100*cc* according to comparative examples (the first comparative example and the second comparative example) will be described with reference to FIGS. 2 to 11. The compression apparatus 100*c* and the compression apparatus 100*cc* according to the first comparative example and the second comparative example, respectively, will be described below by using the same reference numerals to denote the same components as the compression apparatus 100 according to the embodiment.

Operation of Compressor According to First Comparative Example

Figure 2:
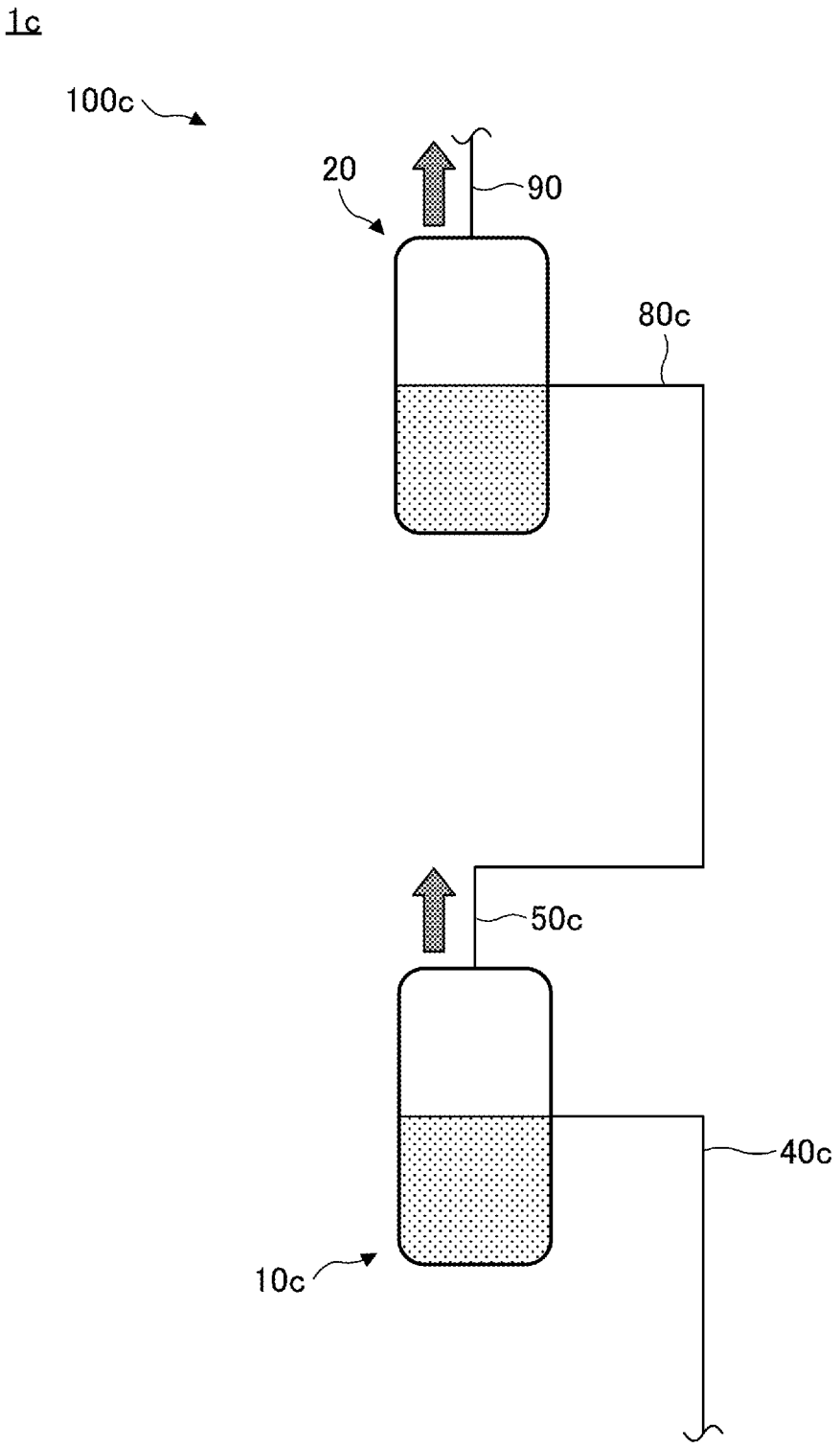
FIG. 2 is a diagram illustrating an example of the operation of the compression apparatus according to the first comparative example.
Figure 3:
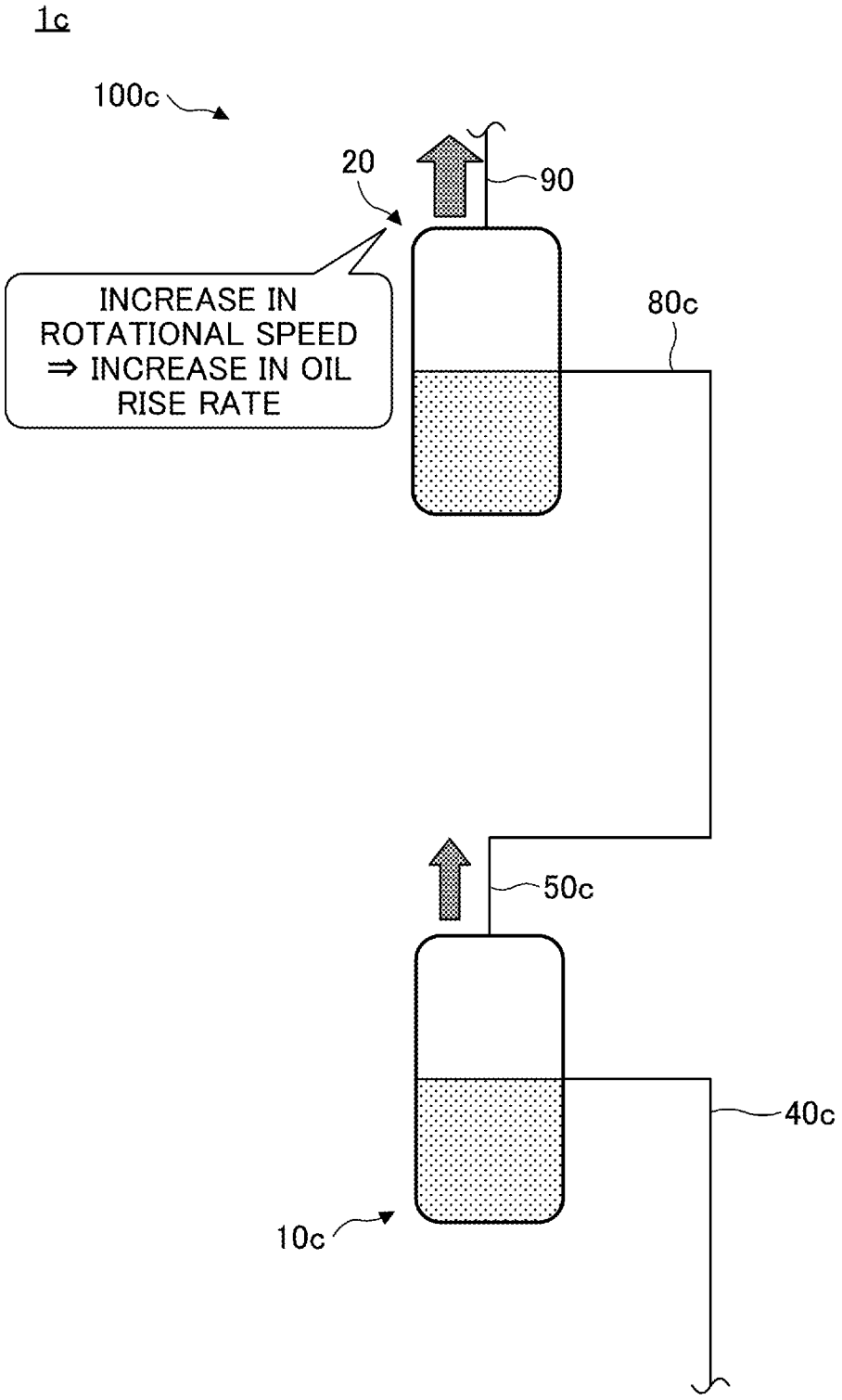
FIG. 3 is a diagram illustrating another example of the operation of the compression apparatus according to the first comparative example.
Figure 4:
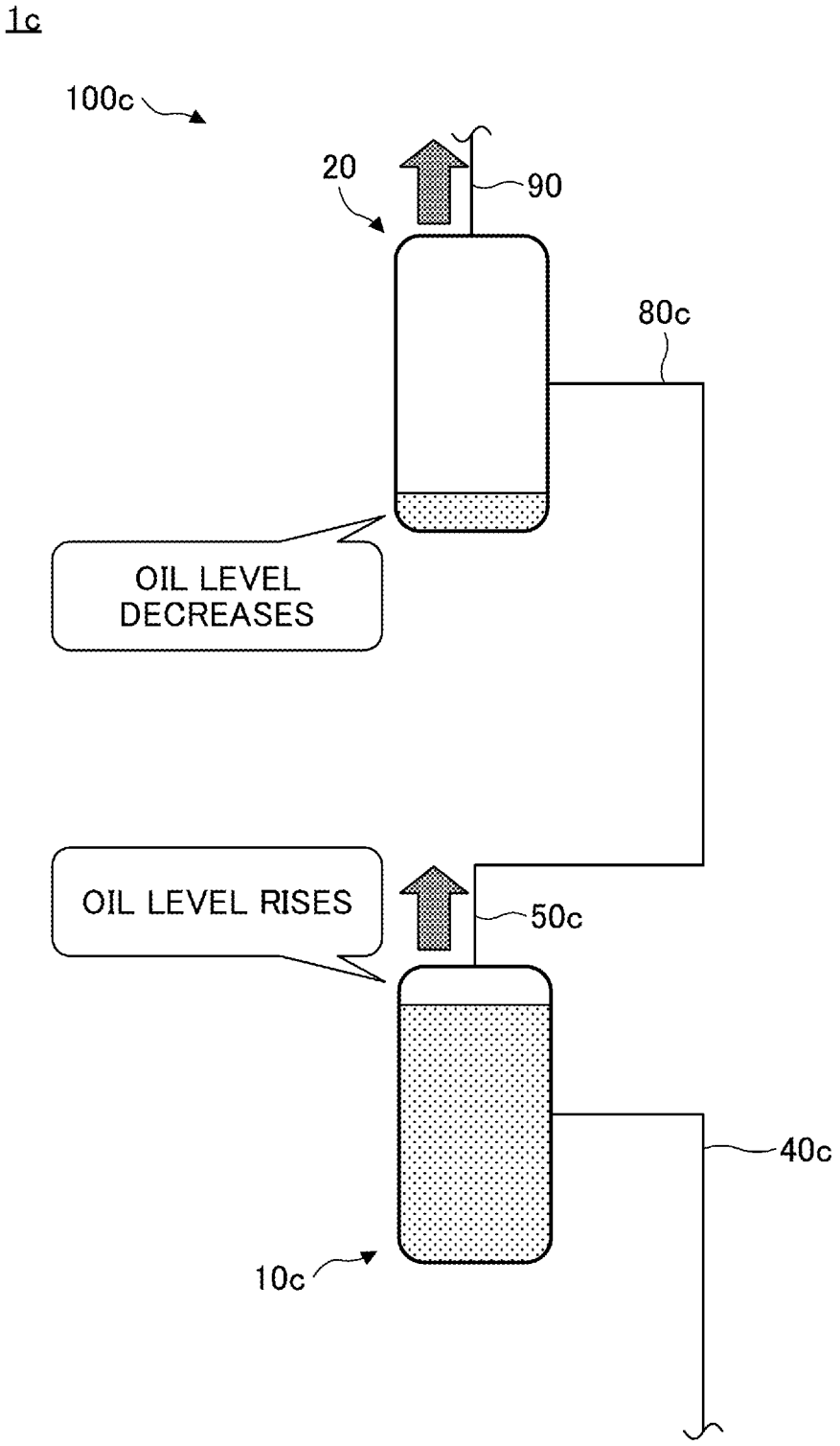
FIG. 4 is a diagram illustrating another example of the operation of the compression apparatus according to the first comparative example.
Figure 5:
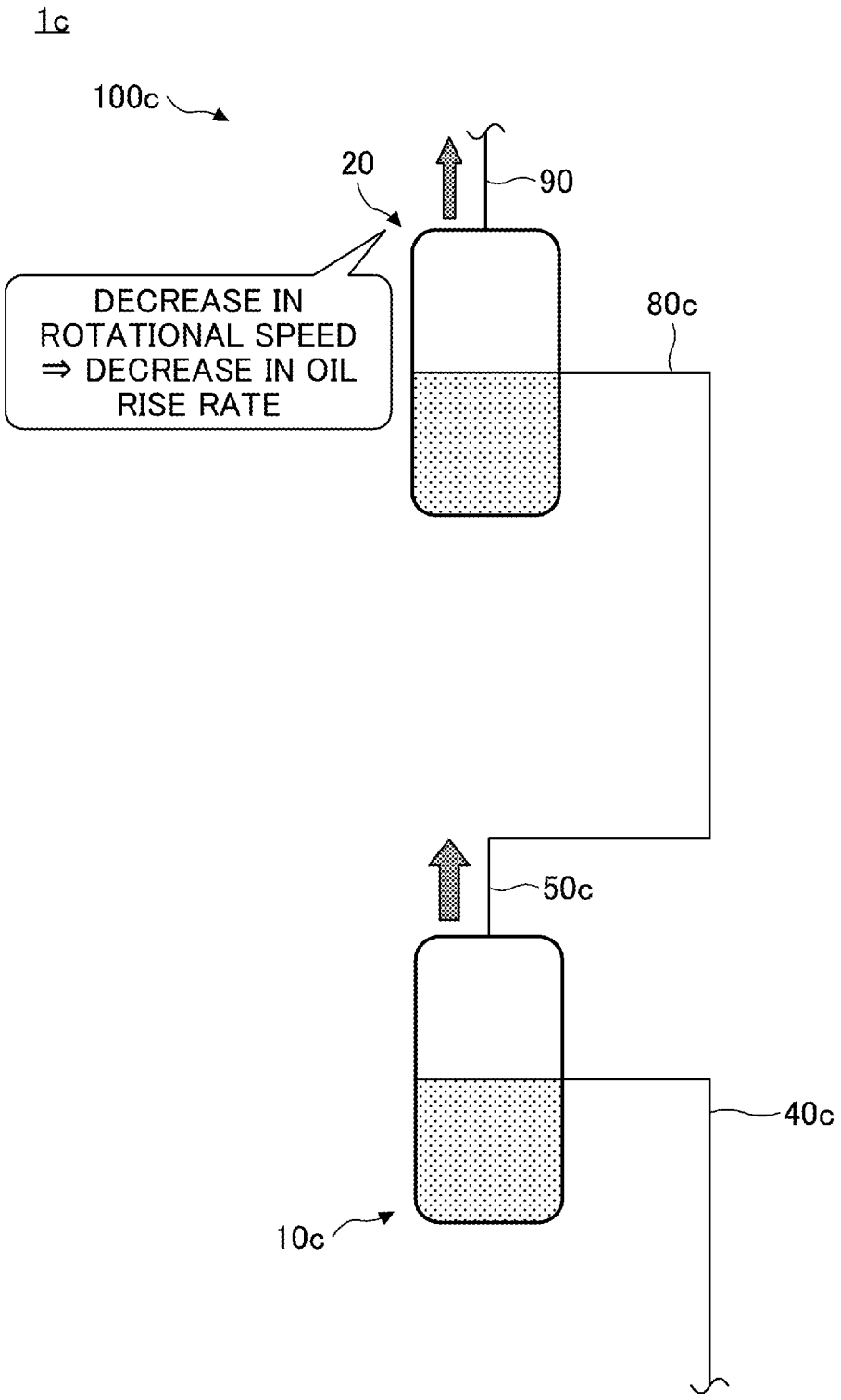
FIG. 5 is a diagram illustrating yet another example of the operation of the compression apparatus according to the first comparative example.
Figure 6:
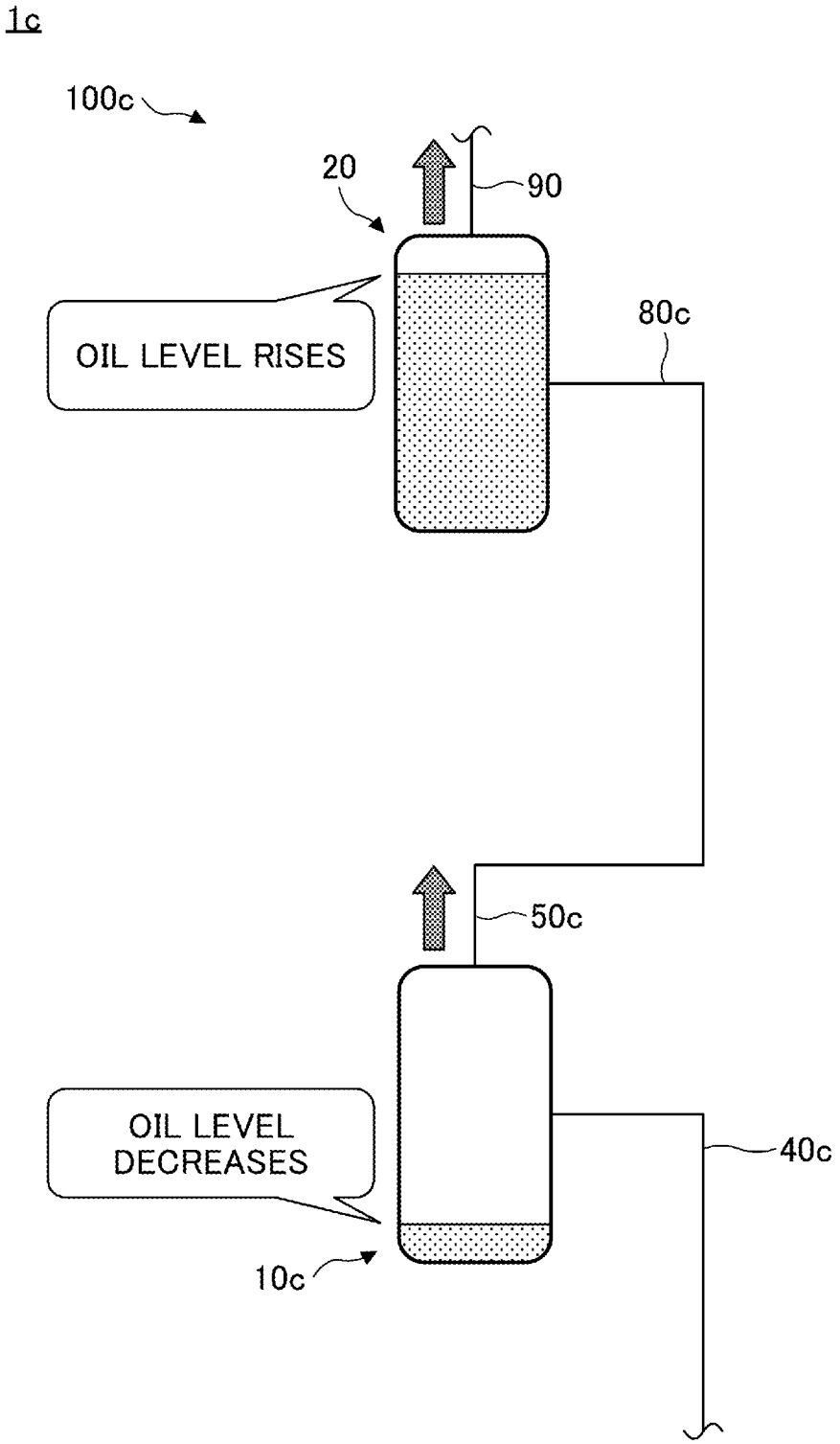
FIG. 6 is a diagram illustrating yet another example of the operation of the compression apparatus according to the first comparative example.

FIG. 2 is a diagram illustrating an example of the operation of the compression apparatus 100*c* according to the first comparative example. FIGS. 3 and 4 are diagrams illustrating other examples of the operation of the compression apparatus 100*c* according to the first comparative example. FIGS. 5 and 6 are diagrams illustrating further examples of the operation of the compression apparatus 100*c* according to the first comparative example. Each dotted arrow in the drawings represents the flow of the oil, and the thickness of each arrow represents the flow rate of the oil.

As illustrated in FIGS. 2 to 6, the compression apparatus 100*c* according to the first comparative example is provided in a refrigerant circuit 1*c* and includes a compressor 10*c*, the compressor 20, an intake passage 40*c*, a discharge passage 50*c*, an intake passage 80*c*, and the discharge passage 90. The compression apparatus 100*c* according to the first comparative example differs from the compression apparatus 100 according to the embodiment in that the compressor 10*c* does not include the oil discharge outlet 10A, the oil discharge passage 60 is not provided, and the discharge passage 50*c* does not include the merging point with the oil discharge passage 60. Furthermore, the compression apparatus 100*c* according to the first comparative example differs from the compression apparatus 100 according to the embodiment in that the oil separator 30 and the oil return passage 70 are absent, the discharge passage 50*c* is directly connected to the intake passage 80*c*, and the intake passage 40*c* does not include the merging point with the oil return passage 70. A description will be given hereinafter based on the premise that the characteristics of a rise in oil with respect to the operating state such as the rotational speed (the characteristics of the flow rate of oil discharged together with the refrigerant) are substantially the same between the compressor 10*c* and 20.

Consider a case where, for example, the operating states of the compressors 10*c* and 20 are substantially the same.

In this case, as illustrated in FIG. 2, the flow rates of oil discharged from the compressors 10*c* and 20 are substantially the same. Hence, the compressors 10*c* and 20 include substantially the same amount of oil.

In contrast, consider a case where the rotational speed of the compressor 20, of the compressors 10*c* and 20, increases from the operating state illustrated in FIG. 2.

In this case, as illustrated in FIG. 3, the oil rise rate of the compressor 20 increases in accordance with the increase in the rotational speed of the compressor 20. As a result, the flow rate of oil that is circulated in the refrigerant circuit 1*c* and is received by the compressor 10*c* increases. Meanwhile, the oil rise rate of the compressor 10*c* is maintained, thus causing the flow rate of the oil received by the compressor 20 to be maintained. Hence, as illustrated in FIG. 4, the oil level of the compressor 10*c* rises in accordance with the increase in the amount of oil contained in the compressor 10*c*, and the oil level of the compressor 20 falls in accordance with the decrease in the amount of oil contained in the compressor 20.

Furthermore, a similar phenomenon can also occur in a case where, for example, the rotational speed of the compressor 10*c* decreases and the oil rise rate of the compressor 10*c* accordingly decreases.

A case where the rotational speed of the compressor 20 of the compressors 10 and 20 decreases from the operating state illustrated in FIG. 2 will be further considered.

In this case, as illustrated in FIG. 5, the oil rise rate of the compressor 20 decreases in accordance with the reduction in the rotational speed of the compressor 20, thus reducing the flow rate of the oil received by the compressor 10*c*. Meanwhile, the oil rise rate of the compressor 10*c* is maintained, thus causing the flow rate of oil received by the compressor 20 to be maintained. Hence, as illustrated in FIG. 6, as the oil level of the compressor 10*c* falls due to the decrease in the amount of oil contained in the compressor 10*c*, the oil level of the compressor 20 rises due to the increase in the amount of oil contained in the compressor 20.

Furthermore, a similar phenomenon can also occur in a case where, for example, the rotational speed of the compressor 10*c* increases and the oil rise rate of the compressor 10*c* accordingly increases.

In this manner, in the compression apparatus 100*c* according to the first comparative example, the respective amounts of oil contained in the compressors 10*c* and 20 may not be equalized because neither of the compressors 10*c* and 20 includes a discharge outlet capable of discharging excess oil contained therein or is provided with an oil discharge passage or the like.

Operation of Compressor According to Second Comparative Example

Figure 7:
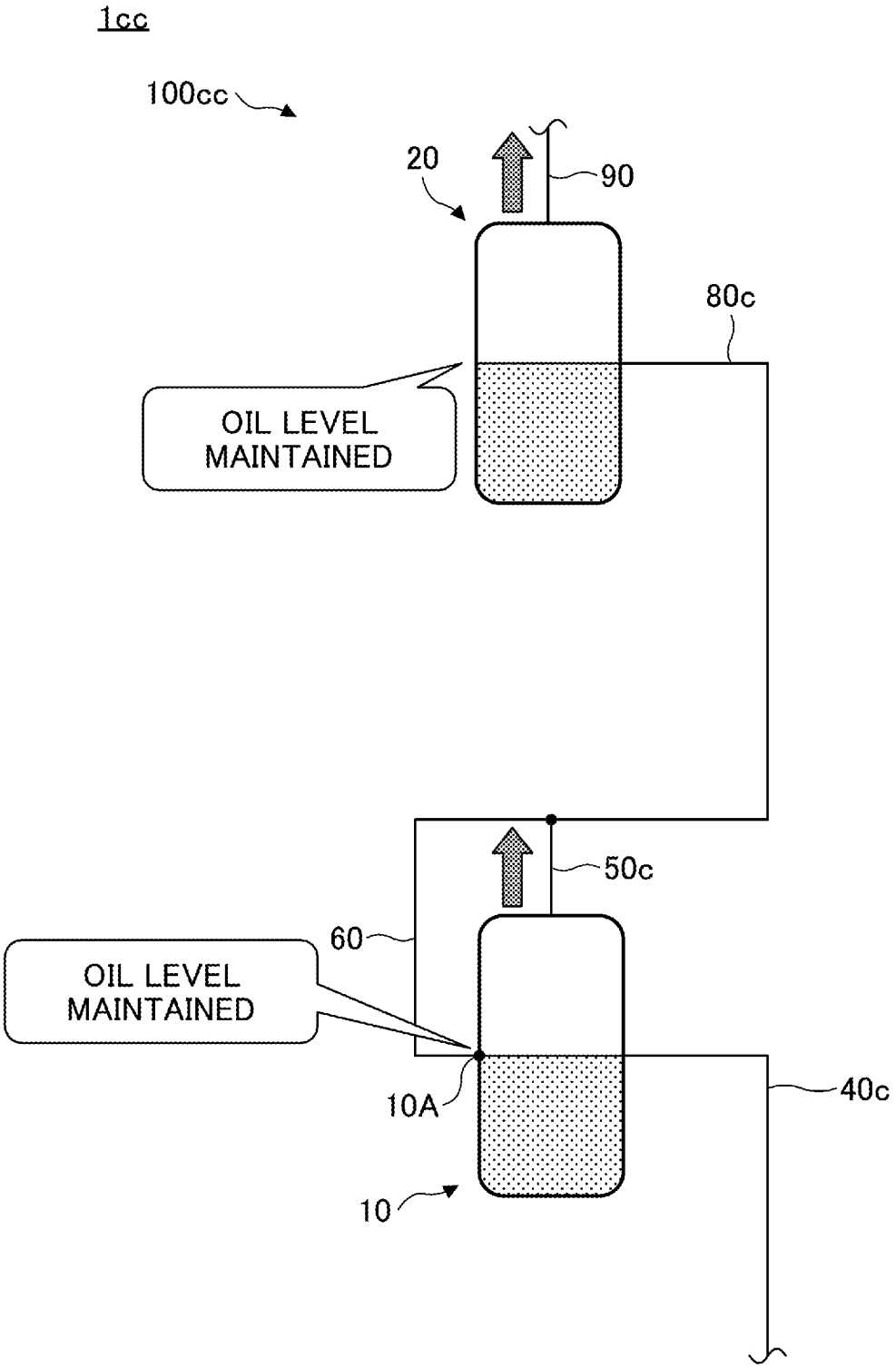
FIG. 7 is a diagram illustrating an example of the operation of the compression apparatus according to the second comparative example.
Figure 8:
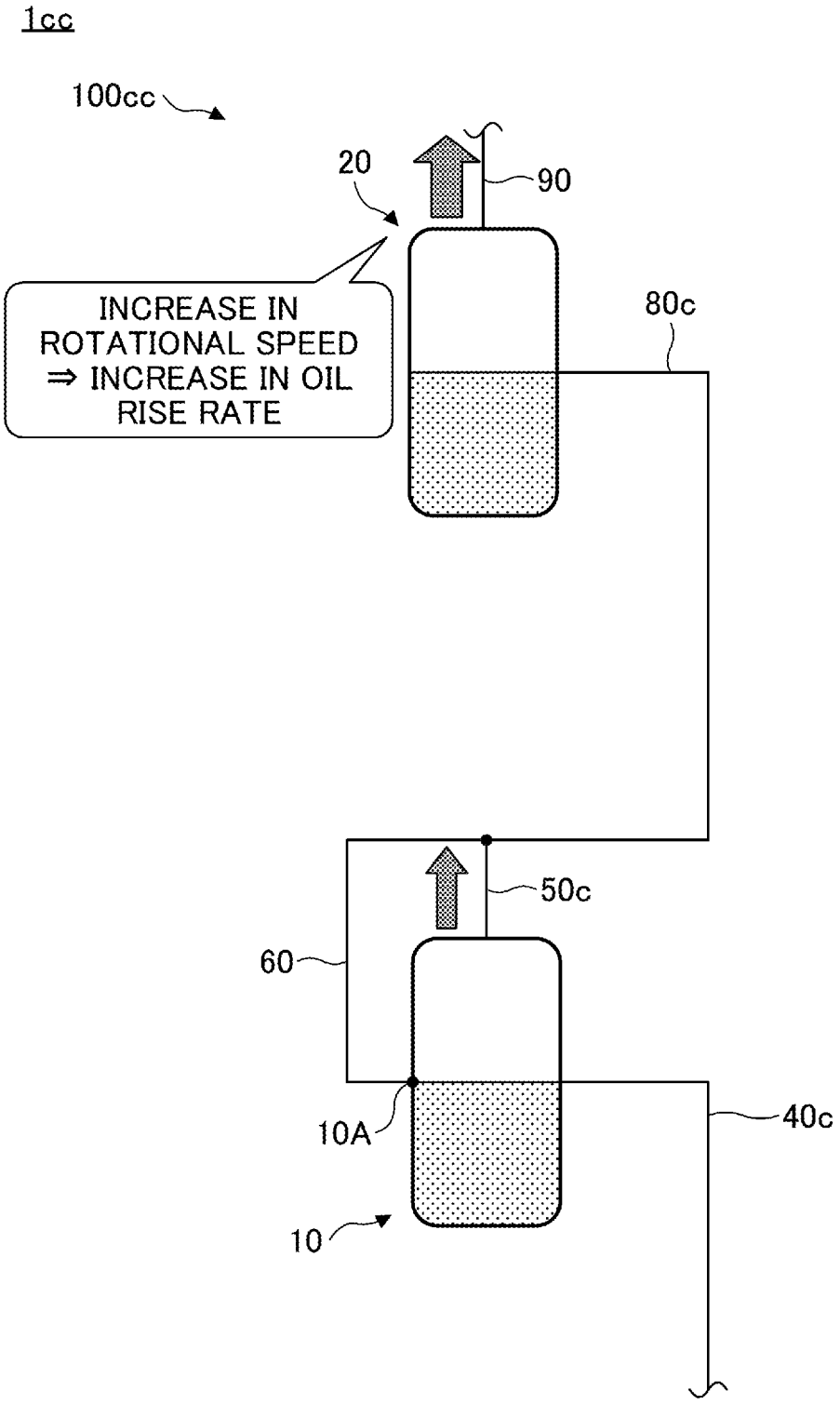
FIG. 8 is a diagram illustrating another example of the operation of the compression apparatus according to the second comparative example.
Figure 9:
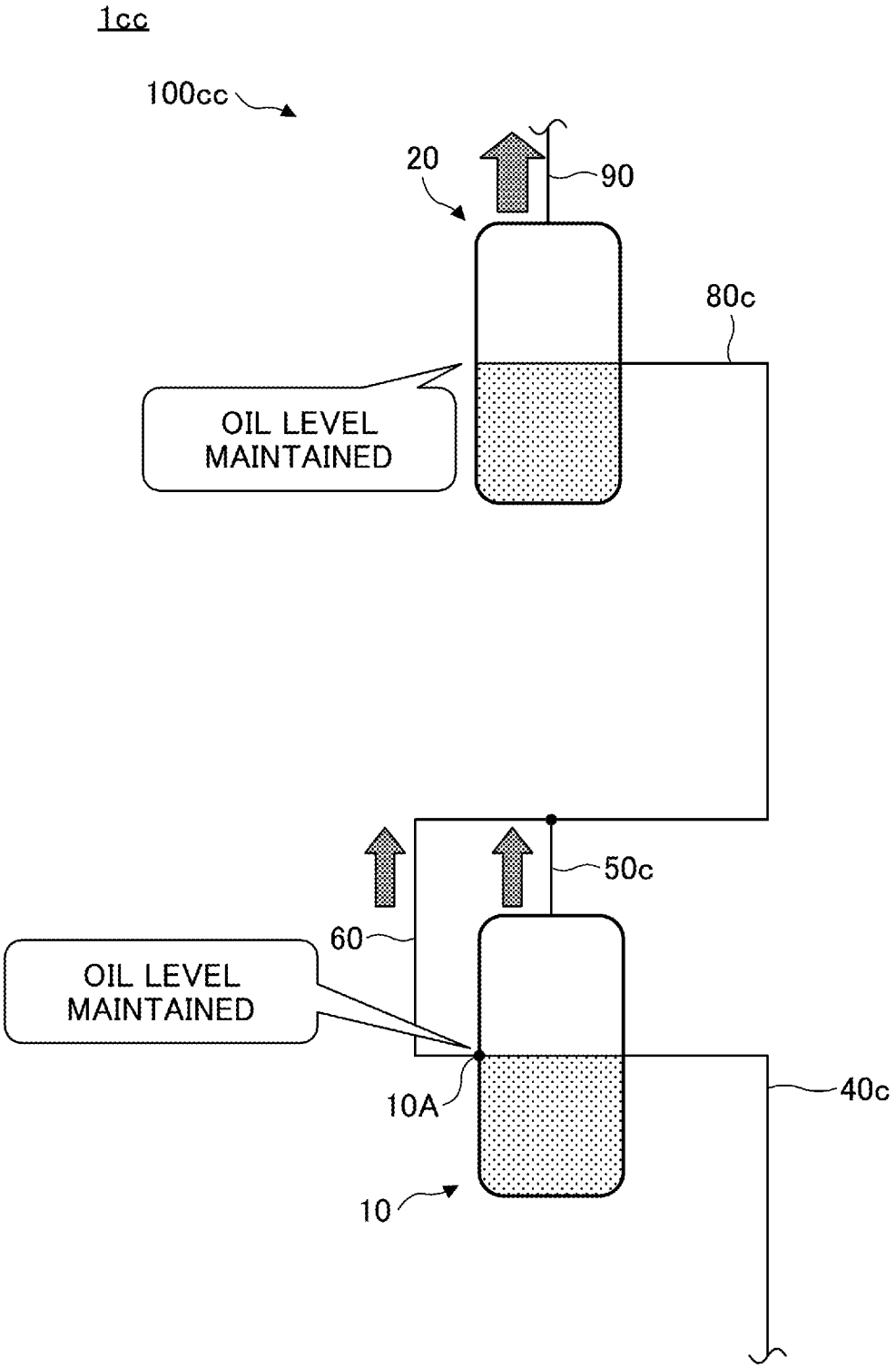
FIG. 9 is a diagram illustrating another example of the operation of the compression apparatus according to the second comparative example.
Figure 10:
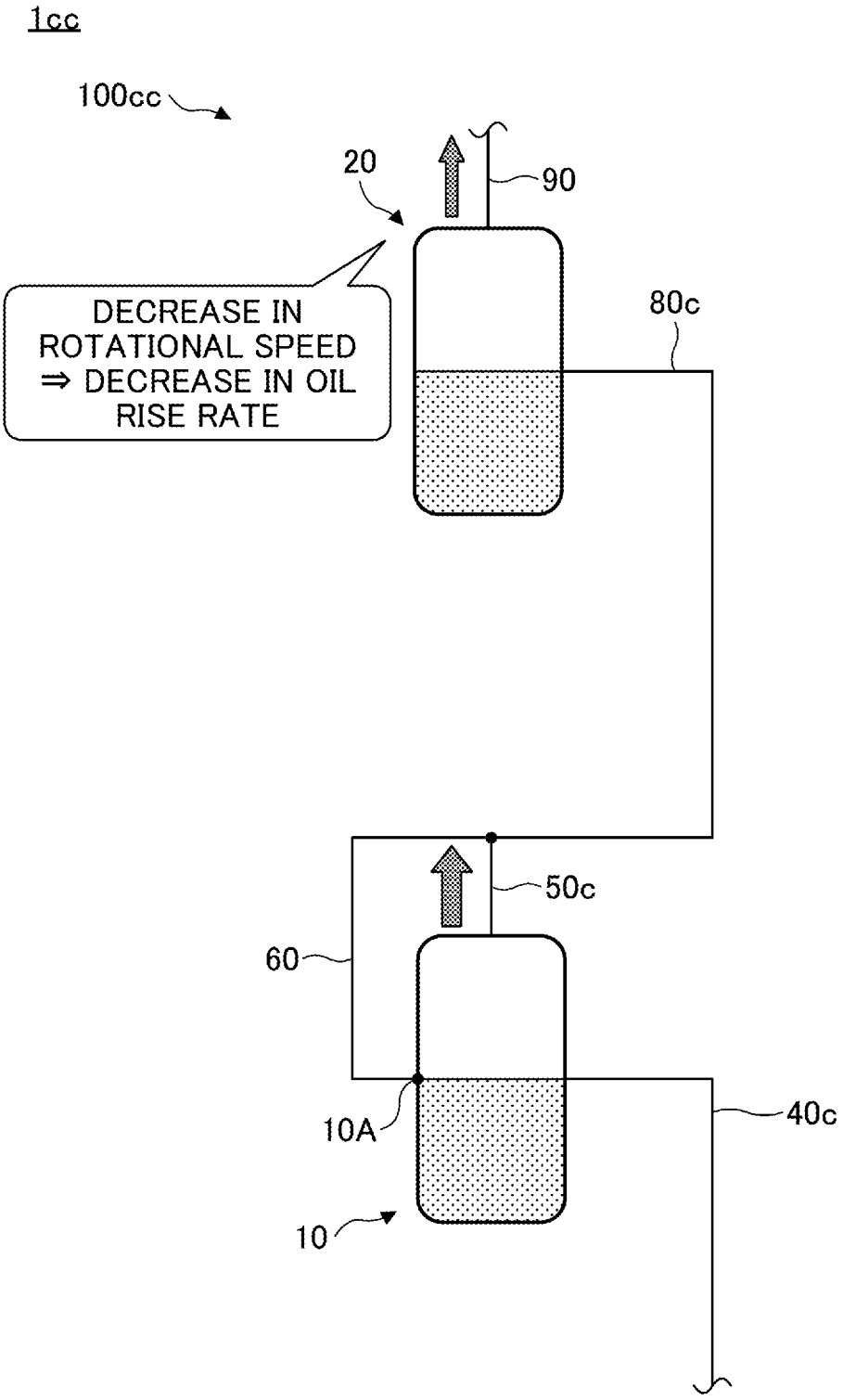
FIG. 10 is a diagram illustrating yet another example of the operation of the compression apparatus according to the second comparative example.
Figure 11:
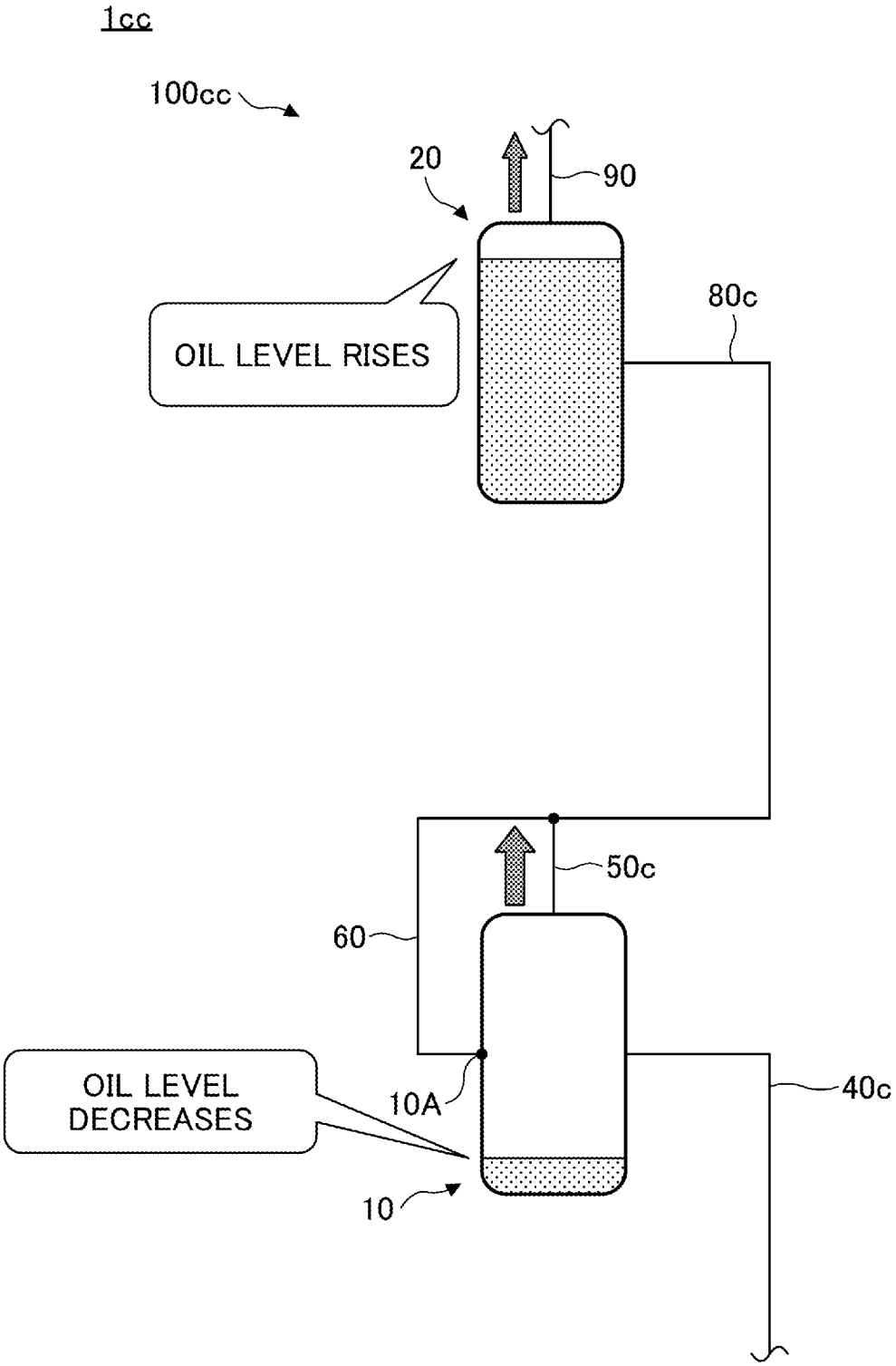
FIG. 11 is a diagram illustrating yet another example of the operation of the compression apparatus according to the second comparative example.

FIG. 7 is a diagram illustrating an example of the operation of the compression apparatus 100*cc* according to the second comparative example. FIGS. 8 and 9 are diagrams illustrating other examples of the operation of the compression apparatus 100*cc* according to the second comparative example. FIGS. 10 and 11 are diagrams illustrating further examples of the operation of the compression apparatus 100*cc* according to the second comparative example. Each dotted arrow in the drawings represents the flow of the oil, and the thickness of each arrow represents the flow rate of the oil.

As illustrated in FIGS. 7 to 11, the compression apparatus 100*cc* according to the second comparative example is provided in a refrigerant circuit 1*cc*. The compression apparatus 100*cc* includes the compressors 10 and 20, the intake passage 40*c*, the discharge passage 50*c*, the oil discharge passage 60, the intake passage 80*c*, and the discharge passage 90. The compression apparatus 100*cc* according to the second comparative example differs from the compression apparatus 100 according to the embodiment in that the oil separator 30 and the oil return passage 70 are absent, the intake passage 40*c* does not include the merging point with the oil return passage 70, and the discharge passage 50*c* is directly connected to the intake passage 80*c*. A description will be given hereinafter based on the premise that the characteristics of the rise in oil with respect to the operating state such as the rotational speed are substantially the same between the compressor 10 and 20.

Consider a case where, for example, the operating states of the compressors 10 and 20 are substantially the same.

In this case, as illustrated in FIG. 7, the respective flow rates (oil rise rates) of the oil discharged from the compressors 10 and 20 are substantially the same. Hence, the compressors 10 and 20 contain substantially the same amount of oil.

Further, consider a case where, for example, the rotational speed of the compressor 20, of the compressors 10 and 20, increases from the operating state illustrated in FIG. 7.

In this case, as illustrated in FIG. 8, the oil rise rate of the compressor 20 increases in accordance with the increase in the rotational speed of the compressor 20. As a result, the flow rate of the oil circulated in the refrigerant circuit 1*cc* and received by the compressor 10 increases. Further, the oil rise rate of the compressor 10 is maintained, but the flow rate of the oil received by the compressor 10 increases. Hence, the excess oil is discharged to the discharge passage 50*c* through the oil discharge outlet 10A and the oil discharge passage 60 in accordance with the rise of the oil level in the compressor 10. Therefore, as illustrated in FIG. 9, the amount of oil contained in the compressor 20 remains substantially constant. Further, as the oil that is directly discharged together with the refrigerant from the compressor 20 merges in the discharge passage 50*c* with the oil that flows in through the oil discharge passage 60, the flow rate of oil received by the compressor 20 increases through the discharge passage 50*c* and the intake passage 80*c*. Hence, as illustrated in FIG. 9, the flow rate of oil received by the compressor 20 increases in accordance with the increase in the oil rise rate of the compressor 20, thus causing the amount of oil contained in the compressor 20 to remain substantially constant. Therefore, the compressors 10 and 20 contain substantially the same amount of oil.

Furthermore, a similar phenomenon can also occur in a case where, for example, the rotational speed of the compressor 10 decreases and the oil rise rate of the compressor 10 accordingly decreases.

A case where the rotational speed of the compressor 20, of the compressors 10 and 20, decreases from the operating state illustrated in FIG. 7 will be further considered.

In this case, as illustrated in FIG. 10, the oil rise rate of the compressor 20 decreases along with the decrease in the rotational speed of the compressor 20. As a result, the flow rate of oil received by the compressor 10 decreases. Meanwhile, the oil rise rate of the compressor 10 is maintained, thus causing the flow rate of oil received by the compressor 20 to be maintained. Hence, as illustrated in FIG. 11, as the oil level of the compressor 10 falls due to the decrease in the amount of oil contained in the compressor 10, the oil level of the compressor 20 rises due to the increase in the amount of oil contained in the compressor 20.

Furthermore, a similar phenomenon can also occur in a case where, for example, the rotational speed of the compressor 10 increases and the oil rise rate of the compressor 10 decreases.

In this manner, since the compressor 10 of the compressors 10 and 20 includes the oil discharge outlet 10A and is also provided with the oil discharge passage 60, the compression apparatus 100*cc* according to the second comparative example can appropriately manage a situation where the amount of oil contained in the compressor 10 increases. However, since the compressor 20 does not include the oil discharge outlet and is not provided with the oil discharge passage, the compression apparatus 100*cc* according to the second comparative example cannot manage a situation where the amount of oil contained in the compressor 20 increases, and may not be able to equalize the respective amounts of oil contained in the compressors 10 and the compressor 20.

Operation of Compressor According to Embodiment

The operation of the compression apparatus 100 according to the embodiment will be described with reference to FIGS. 12 to 15.

Figure 12:
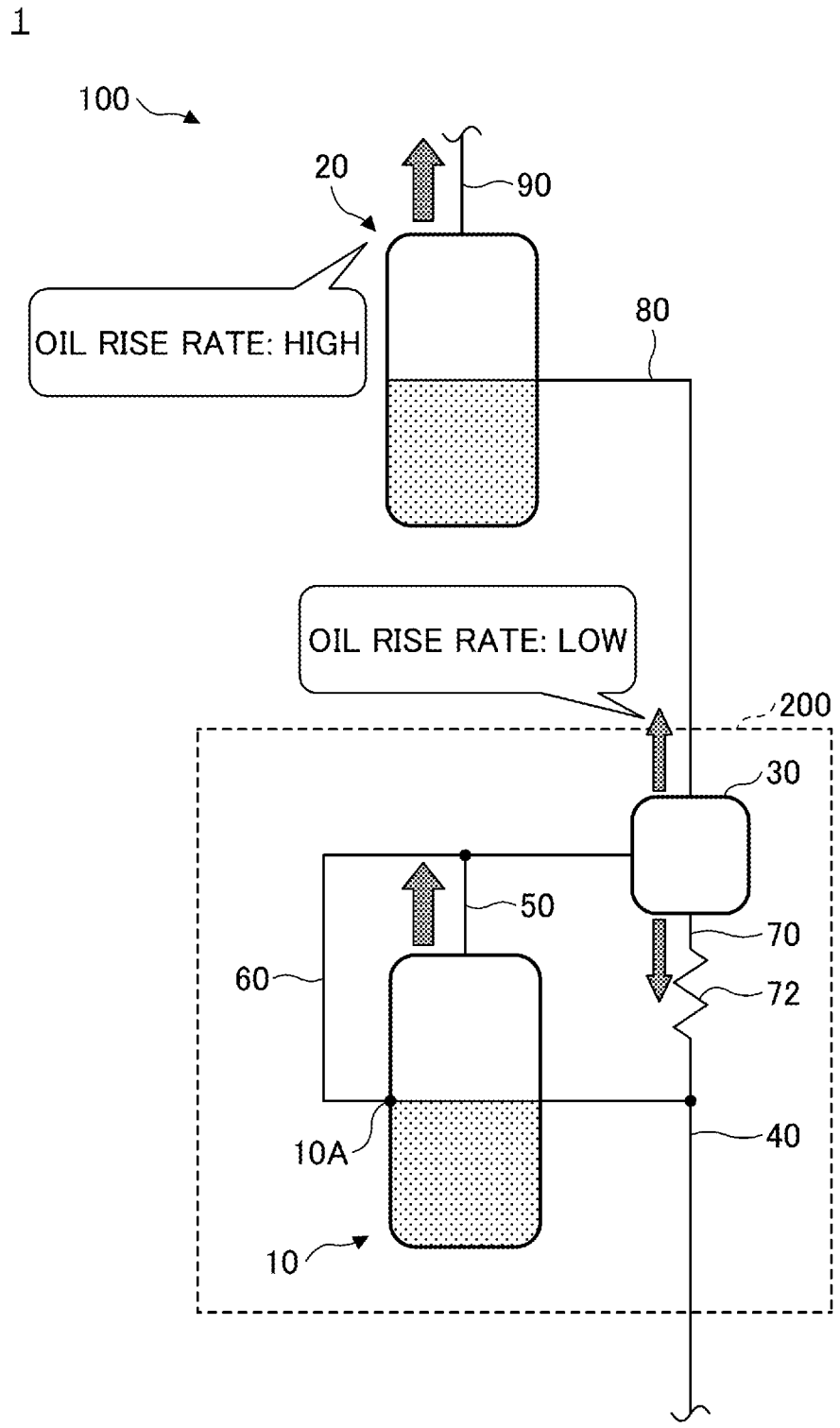
FIG. 12 is a diagram illustrating an example of the operation of the compression apparatus according to the embodiment.
Figure 13:
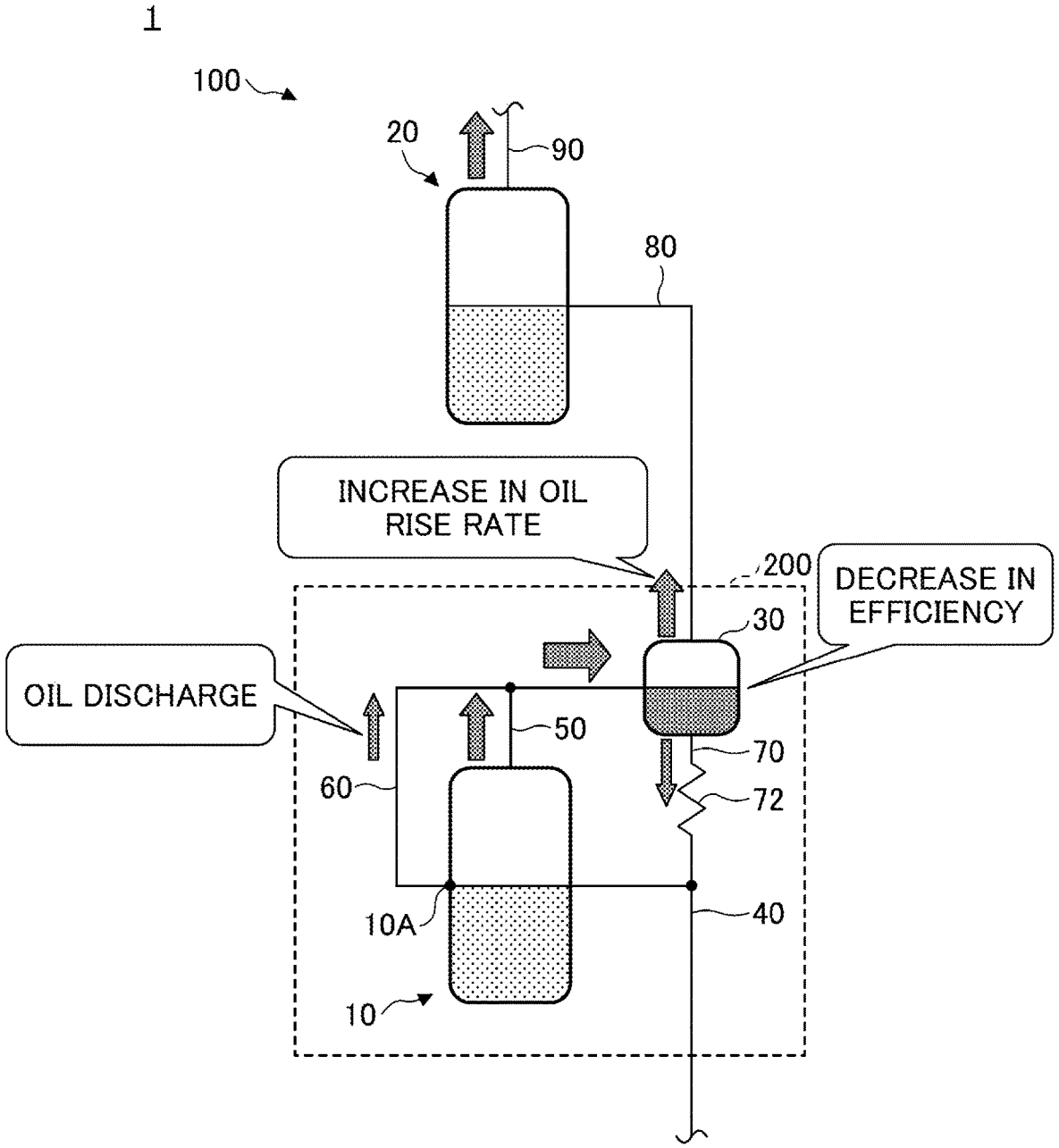
FIG. 13 is a diagram illustrating an example of the operation of the compression apparatus according to the embodiment.
Figure 14:
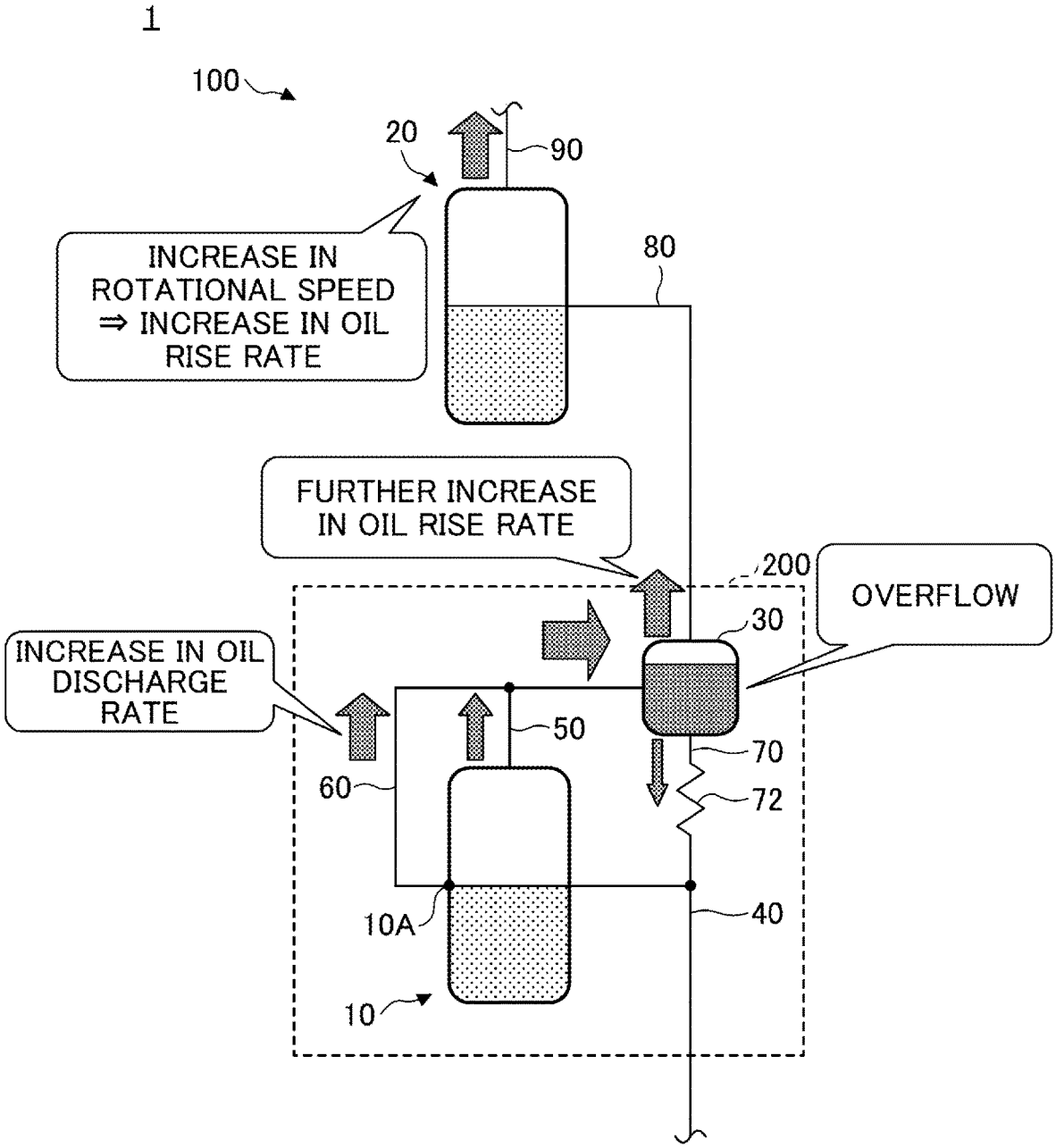
FIG. 14 is a diagram illustrating another example of the operation of the compression apparatus according to the embodiment.
Figure 15:
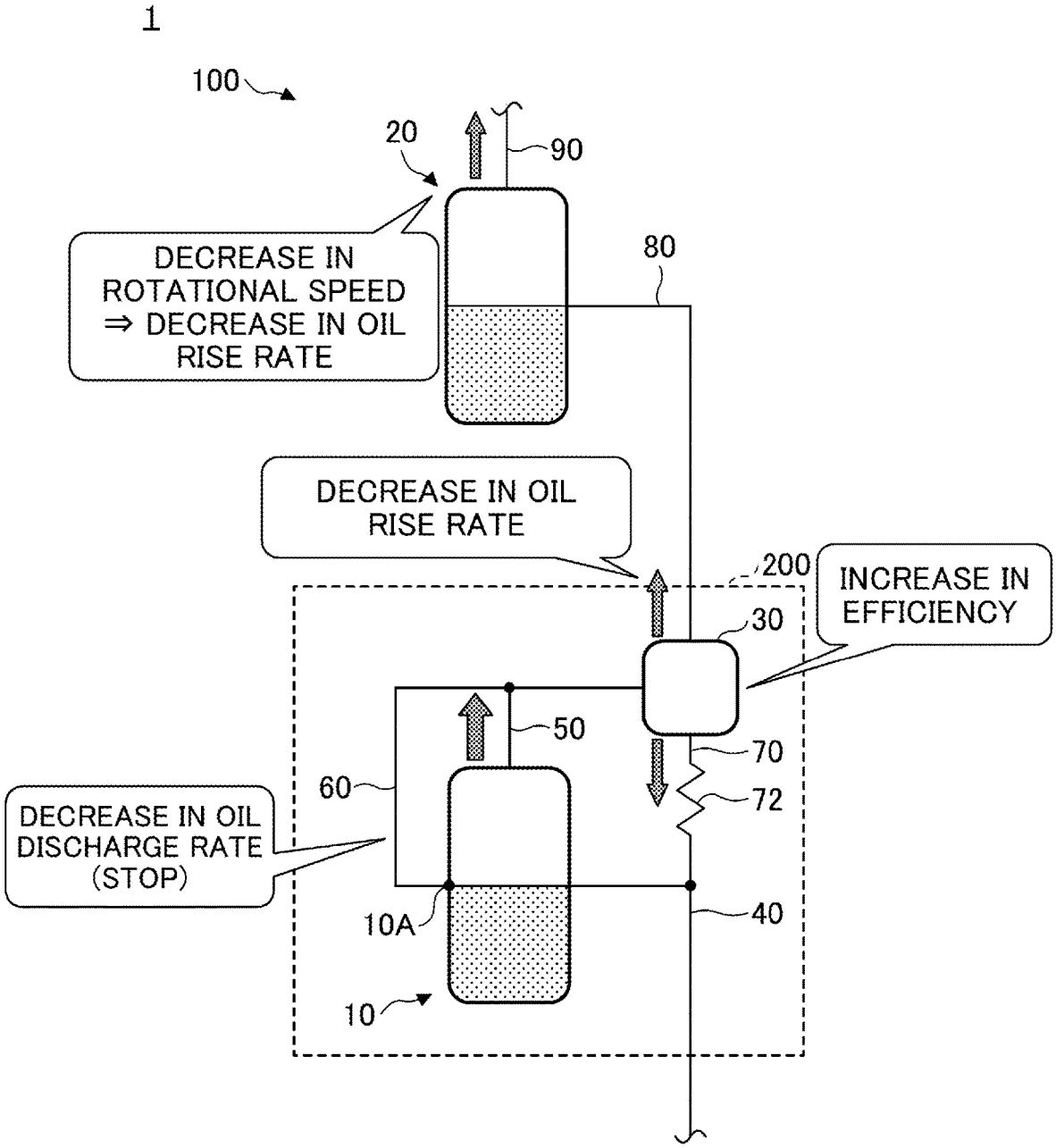
FIG. 15 is a diagram illustrating yet another example of the operation of the compression apparatus according to the embodiment.

FIGS. 12 and 13 are diagrams illustrating examples of the operation of the compression apparatus 100 according to the embodiment. FIG. 14 is a diagram illustrating another example of the operation of the compression apparatus 100 according to the embodiment. FIG. 15 is a diagram illustrating yet another example of the operation of the compression apparatus 100 according to the embodiment. Each dotted arrow in the drawings represents the flow of the oil, and the thickness of each arrow represents the flow rate of the oil.

Consider a case where, for example, the operating states of the compressors 10 and 20 are substantially the same.

In this case, as illustrated in FIG. 12, the flow rates of oil discharged from the compressors 10 and 20 are substantially the same.

As illustrated in FIG. 12, the oil separator 30 is configured such that, in a state where there is no accumulation of oil in the oil separator 30, the flow rate (oil rise rate) of the oil contained in the refrigerant to be discharged to the intake passage 80 becomes lower than the oil rise rate of the compressor 20. As a result, in the compressor 20, in a state where there is no accumulation of oil in the oil separator 30, the flow rate of oil received from the intake passage 80 decreases relative to the flow rate (oil rise rate) of oil discharged to the discharge passage 90. Meanwhile, the oil separated by the oil separator 30 is returned to the intake passage 40 of the compressor 10 via the oil return passage 70. Thus, as illustrated in FIG. 13, the oil contained in the compressor 10 is discharged to the discharge passage 50 through the compressor 10A and the oil discharge passage 60 in accordance with the increase in the amount of oil contained in the compressor 10. Hence, in the compressor 10, the flow rate of oil received from the intake passage 40 is in balance with the total of the flow rate of oil directly discharged to the discharge passage 50 and the flow rate of oil discharged to the oil discharge passage 60. Therefore, the amount of oil (the oil level) contained in the compressor 10 can remain substantially constant.

The oil contained in the compressor 10, which is discharged to the discharge passage 50 via the oil discharge passage 60, merges with the oil directly discharged to the discharge passage 50 from the compressor 10 and flows into the oil separator 30. Hence, the increase in the flow rate of oil that flows into the oil separator 30 reduces the efficiency (to be referred to as "separation efficiency" hereinafter) at which the oil separator 30 separates the refrigerant from the oil, thus causing the oil to accumulate in the oil separator 30. This is because there is an upper limit to the flowrate of oil that can flow to the oil return passage 70, including the action of the capillary tube 72. The flow rate (oil rise rate) of the oil that is discharged from the oil separator 30 to the intake passage 80 increases in accordance with the reduction in the separation efficiency of the oil separator 30. Hence, in the compressor 20, the flow rate of the oil received from the intake passage 80 is in balance with the flow rate (oil rise rate) of the oil discharged to the discharge passage 90. Therefore, the amount (oil level) of oil contained in the compressor 20 can remain substantially constant.

In this manner, in a case in which the operating states of the compressors 10 and 20 are substantially the same, the compression apparatus 100 according to the embodiment can equalize the respective amounts of oil contained in the compressors 10 and 20 in a state where there is a relative reduction in the separation efficiency of the oil separator 30 and the oil has accumulated in the oil separator 30.

Further, consider a case where, for example, the rotational speed of the compressor 20, of the compressors 10 and 20, increases from the operating state illustrated in FIG. 13.

In this case, as illustrated in FIG. 14, the oil rise rate of the compressor 20 increases in accordance with the increase in the rotational speed of the compressor 20. As a result, the flow rate of the oil received by the compressor 10 increases. Meanwhile, the oil rise rate of the compressor 10 is maintained. As a result, as illustrated in FIG. 14, the flow rate of the oil discharged from the compressor 10 to the discharge passage 50 through the oil discharge outlet 10A and the oil discharge passage 60 increases. Hence, in the compressor 10, the flow rate of the oil received from the intake passage 40 is in balance with the total of the flow rate of the oil directly discharged to the discharge passage 50 and the flow rate of oil discharged to the oil discharge passage 60, thus allowing the amount (oil level) of oil contained in the compressor 10 to remain substantially constant.

Further, the increase in the flow rate of the oil discharged from the compressor 10 to the discharge passage 50 through the oil discharge outlet 10A and the oil discharge passage 60 increases the flow rate of the oil that flows into the oil separator 30 through the discharge passage 50. This further reduces the separation efficiency of the oil separator 30, thus causing the oil to further accumulate in the oil separator 30. As a result, the oil separator 30 overflows, increasing the flow rate of the oil (oil rise rate) discharged from the oil separator 30 to the intake passage 80. Hence, in the compressor 20, the flow rate of the oil received from the intake passage 80 is in balance with the flow rate of oil (oil rise rate) discharged to the discharge passage 90, thus allowing the amount (oil level) of oil contained in the compressor 10 to remain substantially constant.

In this manner, in the compression apparatus 100 according to the embodiment, in a case where the oil rise rate of the compressor 20 increases, the respective amounts of oil contained in the compressors 10 and 20 can be equalized by further reducing the separation efficiency of the oil separator 30.

Further, a case where the rotational speed of the compressor 20, of the compressors 10 and 20, decreases from the operating state illustrated in FIG. 13 will be considered.

In this case, as illustrated in FIG. 15, the oil rise rate of the compressor 20 decreases in accordance with the decrease in the rotational speed of the compressor 20. As a result, the flow rate of the oil received by the compressor 10 decreases. Meanwhile, the oil rise rate of the compressor 10 is maintained. Thus, as illustrated in FIG. 15, the flow rate of the oil discharged from the compressor 10 to the discharge passage 50 through the oil discharge outlet 10A and the oil discharge passage 60 decreases and, in some cases, the discharge of the oil stops. Hence, in the compressor 10, the flow rate of the oil received from the intake passage 40 is in balance with the total of the flow rate of the oil directly discharged to the discharge passage 50 and the flow rate of the oil discharged to the oil discharge passage 60, thus allowing the amount (oil level) of oil contained in the compressor 10 to be maintained.

Furthermore, the decrease in the flow rate of the oil discharged from the compressor 10 through the oil discharge outlet 10A and the oil discharge passage 60 decreases the flow rate of oil that flows into the oil separator 30 through the discharge passage 50. This increases (improves) the separation efficiency of the oil separator 30, thus decreasing the amount of the oil accumulated in the oil separator 30. As a result, the flow rate (oil rise rate) of the oil discharged from the oil separator 30 to the intake passage 80 is decreased. Hence, in the compressor 20, the flow rate of the oil received from the intake passage 80 is in balance with the flow rate (oil rise rate) of the oil discharged to the discharge passage 90, thus allowing the amount (oil level) of the oil contained in the compressor 10 to be maintained.

In this manner, in the compression apparatus 100 according to the embodiment, in a case where the oil rise rate of the compressor 20 decreases, the respective amounts of oil contained in the compressors 10 and the 20 can be equalized by increasing (improving) the separation efficiency of the oil separator 30.

Furthermore, when the oil rise rate of the compressor 10 increases due to, for example, the rotational speed of the compressor 10 increasing from the operating state illustrated in FIG. 13, the amount of oil contained in the compressor 10 decreases, conversely, and the flow rate of the oil discharged to the discharge passage 50 through the oil discharge outlet 10A and the oil discharge passage 60 is decreased as a result. In a similar manner, when the oil rise rate of the compressor 10 decreases due to, for example, the rotational speed of the compressor 10 decreasing from the operating state illustrated in FIG. 13, the amount of oil contained in the compressor 10 increases, conversely, and the flow rate of the oil discharged to the discharge passage 50 through the oil discharge outlet 10A and the oil discharge passage 60 is increased as a result. Hence, even if the oil rise rate of the compressor 10 increases or decreases from the operating state illustrated in FIG. 13, the flow rate of the oil that flows into the oil separator 30 from the discharge passage 50 hardly changes, thus allowing the state illustrated in FIG. 13 to be maintained. Therefore, the compression apparatus 100 according to the embodiment is able to equalize the respective amounts of oil contained in the compressors 10 and 20 in accordance with the increase and decrease of the oil rise rate of the compressor 10.

Other Embodiments

Other embodiments will be described next.

The above-described embodiment may be modified or changed as appropriate.

For example, the oil discharge outlet 10A, the oil discharge passage 60, the oil separator 30, and the oil return passage 70 corresponding to the compressor 10 on the low stage side (low pressure side) may be omitted, and an oil discharge outlet may be provided in the compressor 20 on the high stage side (high pressure side) along with an oil discharge passage, an oil separator, and an oil return passage.

The compression apparatus 100 may also include, for example, three or more compressors that are series connected in the refrigerant circuit 1. In such a case, in a similar manner to the above-described embodiment, only some of the compressors of the three or more compressors may include an oil discharge outlet and be provided with an oil discharge passage, an oil separator, and an oil return passage, and the remaining compressors may neither include an oil discharge outlet nor be provided with an oil discharge passage, an oil separator, and an oil return passage. More specifically, in a case where three compressors are series connected, only two of the compressors may include an oil discharge outlet and be provided with an oil discharge passage, an oil separator, and an oil return passage. As a result, the respective amounts of oil contained in all of the three or more compressors, including the remaining compressors without the oil discharge outlet, can be equalized based on the action of the oil discharge passage, the oil separator, the oil return passage, and the like provided in some of the compressors.

Furthermore, for example, the compression apparatus 100 may include, in addition to two or more compressors that are series connected in the refrigerant circuit 1, another compressor that is parallel-connected with respect to one of the series-connected compressors. In this case, as long as the one compressor includes an oil discharge outlet and is provided with an oil discharge passage, an oil separator, and an oil return passage, the other compressors may also include an oil discharge passage, and be provided with an oil separator, and an oil return passage.

Effects

The effects of the compression apparatus 100 according to the embodiment will be described next.

In the embodiment, a plurality of compressors (for example, the compressors 10 and 20) are series connected in the refrigerant circuit 1 that circulates a refrigerant. An oil separator (for example, the oil separator 30) is provided in a discharge passage (for example, the discharge passage 50) of one compressor (for example, the compressor 10) of the plurality of compressors, separates oil from the refrigerant discharged from the one compressor, and causes the refrigerant separated from the oil to flow downstream. An oil discharge outlet (for example, the oil discharge outlet 10A) is provided in the above-described one compressor. An oil discharge passage (for example, the oil discharge passage 60) is provided in the above-described one compressor, and connects the oil discharge outlet of the one compressor with an inlet of the oil separator. An oil return passage (for example, the oil return passage 70) is provided in the above-described one compressor, and returns the oil separated by the oil separator to an intake passage (for example, the intake passage 40) of the one compressor.

As a result, the compression apparatus 100 can use the oil separator to separate the oil contained in the refrigerant that is discharged from the one compressor provided with the oil separator, and can return the separated oil to the one compressor through the oil return passage. Hence, for example, in an operating state where the flow rate of the oil discharged from the one compressor is higher than the flow rate of the oil received by the one compressor, the compression apparatus 100 can suppress the reduction in the amount of oil contained in the one compressor. Further, the compression apparatus 100 can cause the oil separator to separate at least a part of the oil to reduce the flow rate of the oil discharged together with the refrigerant, and thus suppress an increase in the flow rate of the oil received by another compressor. Hence, for example, in an operating state where the flow rate of the oil discharged from the one compressor is higher than the flow rate of the oil received by the one compressor, it is possible to suppress an increase in the amount of oil contained in the other compressor. In addition, when the oil level in the one compressor is higher than or equal to the oil discharge outlet, the compression apparatus 100 can cause the oil contained in the one compressor to be discharged to the inlet of the oil separator through the oil discharge passage. Hence, for example, in an operating state where the flow rate of the oil received by the one compressor is higher than the flow rate of the oil discharged from the one compressor, it is possible to suppress an increase in the amount of oil contained in the one compressor. Furthermore, when the oil contained in the one compressor is discharged through the oil discharge passage and the flow rate of oil that flows into the oil separator relatively increases, the compression apparatus 100 can reduce the oil separation efficiency of the oil separator to increase the flow rate of oil that flows downstream from the oil separator. This is because the flow rate of the oil return path can be limited. Hence, for example, in an operating state where the flow rate of the oil received by the one compressor is higher than the flow rate of the oil discharged from the one compressor, a reduction in the flow rate of the oil received by the other compressor can be suppressed. As a result, it is possible to suppress a reduction in the amount of oil contained in the other compressor. Therefore, the compression apparatus 100 can equalize the respective amounts of oil contained in the plurality of compressors even in a case where compressors other than the one compressor do not include the oil discharge outlet.

Further, in the embodiment, the other compressor(s) different from the above-described one compressor of the plurality of compressors may not include an oil discharge outlet.

As a result, a general compressor without an oil discharge outlet can be employed as the other compressor(s) different from the one compressor that includes the oil discharge outlet and is provided with the oil discharge passage, the oil separator, and the oil return passage.

Furthermore, in the embodiment, the oil separator may be configured such that the flow rate of the oil discharged when the oil is not accumulated inside is lower than the flow rate of the oil discharged together with the refrigerant from the other compressor different from the one compressor that is provided with the oil separator among the plurality of compressors.

Thus, in a state where some oil has been accumulated in the oil separator and the efficiency at which the oil is separated from the refrigerant has relatively decreased, the compression apparatus 100 is able to balance the flow rate of the oil discharged from the oil separator and received by the other compressor with respect to the flow rate of the oil discharged from the other compressor. As a result, the compression apparatus 100 can maintain substantially the same amount of oil in the one compressor and the other compressor in a state where some oil has been accumulated in the oil separator. Hence, for example, when the oil rise rate of the other compressor decreases relative to the oil rise rate of the one compressor, the compression apparatus 100 can reduce the flow rate of the oil discharged from the oil separator to relatively reduce the flow rate of the oil received by the other compressor so as to match the oil rise rate of the other compressor. This is because the flow rate of oil discharged from the one compressor to the oil separator via the oil discharge passage can be reduced. Further, for example, when the oil rise rate of the other compressor increases relative to the oil rise rate of the one compressor, the compression apparatus 100 can increase the flow rate of the oil discharged from the oil separator to relatively increase the flow rate of the oil received by the other compressor so as to match the oil rise rate of the other compressor. This is because the flow rate of oil discharged from the one compressor to the oil separator through the oil discharge passage can be increased, and the oil separation efficiency of the oil separator can be reduced in accordance with the limitation of the flow rate of the oil return passage. Therefore, the compression apparatus 100 can specifically equalize the respective amounts of oil contained in the plurality of compressors.

In addition, in the embodiment, the length, the cross-sectional area (inside diameter), the shape, and the like of the oil discharge passage may be configured such that oil does not accumulate to a height that is higher than or equal to a height at which the oil discharge outlet is provided in the above-described one compressor.

As a result, the compression apparatus 100 is able to specifically cause the one compressor including the oil discharge outlet to discharge excess oil to the oil separator.

In addition, in the embodiment, the oil return path may limit the flow rate of oil such that the flow rate is less than the amount of oil that can be separated per unit time by the oil separator.

As a result, the compression apparatus 100 can cause the oil to accumulate in the oil separator when the flow rate of oil that flows into the oil separator is relatively high.

In addition, in the embodiment, the separated oil may be returned from the oil separator to the above-described one compressor to increase the flow rate of the oil discharged from the one compressor through the oil discharge outlet and the oil discharge passage.

As a result, the compression apparatus 100 can ensure a relatively high flow rate for the oil that is to flow into the oil separator, thus facilitating the accumulation of oil in the oil separator.

In addition, in the embodiment, the amount of oil separated per unit time by the oil separator increases as the flow rate of oil that flows into the oil separator from the above-described one compressor via the discharge passage and the oil discharge passage increases. Subsequently, in the oil separator, the amount of oil separated per unit time increases relative to the flow rate of the oil returned by the oil return passage such that the oil separation efficiency decreases and the flow rate of oil discharged downstream is increased.

As a result, in an operating state where the flow rate of the oil received by the above-described one compressor is higher than the flow rate of the oil discharged from the one compressor, the oil separator can specifically suppress a reduction in the flow rate of the oil received by the other compressor. Hence, in an operating state where the flow rate of the oil received by the one compressor is higher than the flow rate of the oil discharged from the one compressor, the compression apparatus 100 can suppress a reduction in the amount of oil contained in the other compressor, and can equalize the respective amounts of oil contained in the plurality of compressors.

In addition, in the embodiment, when there is no change in the flow rate of oil discharged from the above-described other compressor (see FIG. 13), the oil is accumulated in the oil separator such that the flow rate of the oil discharged from the oil separator and received by the other compressor increases relative to a state where the oil is not accumulated in the oil separator. The increase in the flow rate of the oil received by the other compressor relative to the state where the oil is not accumulated in the oil separator can cause the flow rate of oil received by the other compressor to be in balance with the flow rate of oil discharged from the other compressor.

As a result, when there is no change in the flow rate of oil discharged from the other compressor, the compression apparatus 100 can specifically cause the amount (oil level) of the oil in the other compressor without the oil discharge outlet to remain constant to equalize the respective amounts of oil contained in the plurality of compressors.

In addition, in the embodiment, when the flow rate of the oil discharged from the above-described other compressor increases, the flow rate of the oil that is discharged from the other compressor and is received by the above-described one compressor increases such that the flow rate of the oil that flows into the oil separator from the one compressor through the oil discharge passage increases. Further, the increase in the flow rate of oil that flows into the oil separator causes the oil contained in the oil separator to overflow, thus increasing the flow rate of the oil that is discharged from the oil separator and is received by the other compressor. Subsequently, the increase in the flow rate of oil received by the other compressor can cause the flow rate of oil received by the other compressor to be in balance with the flow rate of oil discharged by the other compressor.

As a result, when the flow rate of the oil discharged from the other compressor increases, the compression apparatus 100 can specifically cause the amount (oil level) of the oil in the other compressor without the oil discharge outlet to remain constant to equalize the respective amounts of oil contained in the plurality of compressors.

In addition, in the embodiment, when the flow rate of the oil discharged from the above-described other compressor decreases, the flow rate of the oil that is discharged from the other compressor and is received by the above-described one compressor decreases such that the flow rate of the oil that flows into the oil separator from the one compressor through the oil discharge passage decreases. Further, the decrease in the flow rate of oil that flows into the oil separator decreases the amount of oil separated per unit time by the oil separator, thus increasing the flow rate of the oil returned by the oil return passage relative to the amount of separated oil. Further, the increase in flow rate of the oil returned by the oil return passage relative to the amount of oil separated per unit time by the oil separator decreases the oil contained in the oil separator, thus increasing the oil separation efficiency of the oil separator. Further, the increase in the oil separation efficiency of the oil separator decreases the flow rate of the oil that is discharged from the oil separator and is received by the other compressor. Subsequently, the decrease in the flow rate of oil received by the other compressor can cause the flow rate of oil received by the other compressor to be in balance with the flow rate of oil discharged by the other compressor.

As a result, when the flow rate of oil discharged from the other compressor decreases, the compression apparatus 100 can specifically cause the amount (oil level) of the oil contained in the other compressor without the oil discharge outlet to remain constant to equalize the respective amounts of oil contained in the plurality of compressors.

Although the embodiments have been described above, it can be understood that various changes can be made to the forms and the details without departing from the spirit and the scope of the appended claims.

Finally, this international application is based on and claims priority to Japanese Patent Application No. 2020-165578, filed on Sep. 30, 2020, the entire contents of which are incorporated herein by reference.

REFERENCE SIGNS LIST

1 refrigerant circuit
10, 20 compressor
30 oil separator
40 intake passage
50 discharge passage
60 oil discharge passage
70 oil return passage
80 intake passage
90 discharge passage
100 compression apparatus
200 compressor unit

The invention claimed is:

1. A compression apparatus comprising a plurality of compressors connected in series in a refrigerant circuit that is configured to circulate a refrigerant;

an oil separator provided in a first discharge passage connected to a first discharge outlet of one compressor of the plurality of compressors, directly upstream of another compressor of the plurality of compressors, and configured to separate oil from the refrigerant discharged from the one compressor and to cause the refrigerant separated from the oil to flow downstream;

an oil return passage provided with the one compressor and configured to return the oil separated by the oil separator to an intake passage of the one compressor;

a second discharge outlet provided in the one compressor; and a second discharge passage configured to connect the second discharge outlet to an inlet of the oil separator, the second discharge passage merging into the first discharge passage upstream of the oil separator.

2. The compression apparatus according to claim 1, wherein a second discharge outlet is not provided in the other compressor of the plurality of compressors.

3. The compression apparatus according to claim 2, wherein the oil separator is configured such that a flow rate of oil discharged downstream from the oil separator when no oil is accumulated in the oil separator is lower than a flow rate of oil discharged from the other compressor.

4. The compression apparatus according to claim 3, wherein the second discharge passage is configured such that the oil does not accumulate to a height that is higher than or equal to a height at which the second discharge outlet is provided in the one compressor.

5. The compression apparatus according to claim 3, wherein the oil return passage is configured to limit a flow rate of oil such that the flow rate is less than an oil separation amount per unit time of the oil separator.

6. The compression apparatus according to claim 3, wherein a flow rate of oil discharged from the one compressor through the second discharge passage increases due to separated oil being returned to the one compressor from the oil separator through the oil return passage.

7. The compression apparatus according to claim 6, wherein in the oil separator, an increase in a flow rate of oil that flows in from the one compressor through the first discharge passage and the second discharge passage causes the oil separation amount per unit time to increase such that the oil separation amount increases relative to a flow rate of oil returned by the oil return passage and the oil is accumulated in the oil separator, and the accumulation of the oil in the oil separator reduces oil separation efficiency such that the flow rate of oil discharged downstream is increased.

8. The compression apparatus according to claim 7, wherein in a case where there is no change in the flow rate of oil discharged from the other compressor, the accumulation of the oil in the oil separator:

increases the flow rate of oil that is discharged from the oil separator and is received by the other compressor relative to a state where the oil is not accumulated in the oil separator, and increases the flow rate of oil received by the other compressor relative to the state where the oil is not accumulated in the oil separator, such that the flow rate of oil received by the other compressor is in balance with the oil discharge flow rate of the other compressor.

9. The compression apparatus according to claim 7, wherein in a case where the flow rate of oil discharged from the other compressor increases, the increase in the flow rate of oil that is discharged from the other compressor and is received by the one compressor increases the flow rate of oil that flows into the oil separator from the one compressor through the second discharge passage, the increase in the flow rate of oil that flows into the oil separator causes the oil in the oil separator to overflow, the overflow of the oil in the oil separator increases the flow rate of oil that is discharged from the oil separator and is received by the other compressor, and the increase in the flow rate of oil received by the other compressor causes the flow rate of oil received by the other compressor to be in balance with the flow rate of oil discharged from the other compressor.

10. The compression apparatus according to claim 7, wherein in a case where the flow rate of oil discharged from the other compressor decreases, the decrease in the flow rate of oil that is discharged from the other compressor and is received by the one compressor decreases the flow rate of oil that flows into the oil separator from the one compressor through the second discharge passage, the decrease in the flow rate of oil that flows into the oil separator decreases the oil separation amount of the oil separator such that the flow rate of oil returned by the oil return passage increases relative to the oil separation amount, the increase in the flow rate of oil returned by the oil return passage relative to the oil separation amount decreases the oil in the oil separator such that the oil separation efficiency of the oil separator is increased, the increase in the oil separation efficiency of the oil separator decreases the flow rate of oil that is discharged from the oil separator and is received by the other compressor, and the decrease in the flow rate of oil received by the other compressor causes the flow rate of oil received by the other compressor to be in balance with the flow rate of oil discharged from the other compressor.

* * * * *